US006788209B2

(12) United States Patent
Cothern et al.

(10) Patent No.: US 6,788,209 B2
(45) Date of Patent: Sep. 7, 2004

(54) AUTOMATIC EMERGENCY SHUT-OFF SYSTEM FOR DELIVERY TRANSPORTS

(75) Inventors: Tony J. Cothern, Los Lunas, NM (US); Ronald H. Bindl, Glendale, AZ (US); Rodney O. Craig, Albuquerque, NM (US); Don Cream, Rio Rancho, NM (US); George B. Freeman, Los Lunas, NM (US)

(73) Assignee: BR&T Technology Development Corporation, Albuquerque, NM (US)

( * ) Notice: Subject to any disclaimer, the term of this patent is extended or adjusted under 35 U.S.C. 154(b) by 62 days.

(21) Appl. No.: 10/104,183

(22) Filed: Mar. 22, 2002

(65) Prior Publication Data

US 2003/0210152 A1 Nov. 13, 2003

(51) Int. Cl.[7] ..... G08B 21/00

(52) U.S. Cl. ..... 340/606; 340/608; 340/609; 340/632; 340/591; 340/451; 141/197; 141/198

(58) Field of Search ..... 340/606, 608, 340/609, 610, 611, 614, 616, 618, 626, 632, 591, 450, 450.2, 451; 141/197, 198

(56) References Cited

U.S. PATENT DOCUMENTS 4,787,410 A * 11/1988 Fujieda et al. ..... 137/78.4
5,027,871 A * 7/1991 Guenther ..... 141/198
5,823,235 A * 10/1998 Alley et al. ..... 141/197
5,975,162 A * 11/1999 Link, Jr. ..... 141/231
5,999,087 A 12/1999 Gunton
6,224,353 B1 * 5/2001 Iseman ..... 417/326
6,467,466 B1 * 10/2002 Maekawa et al. ..... 123/529
6,470,903 B2 * 10/2002 Reyman ..... 137/1
6,575,206 B2 * 6/2003 Struthers et al. ..... 141/94

* cited by examiner

*Primary Examiner*—Jeffery Hofsass
*Assistant Examiner*—Daniel Previl
(74) *Attorney, Agent, or Firm*—Dennis F. Armijo

(57) ABSTRACT

A software driven, solid state controlled, electro-mechanically operated system to monitor volatile liquid fuel or other hazardous liquids and provide emergency shut-off if the delivery system is ruptured. A computer receives input from transducers monitoring the flow rate of the liquid through the line and a pressure sensor insures the system is prepared to function. The monitoring apparatus presets a condition based on current environmental conditions. Measuring the flow rate provides input to software that validates all other entries. Delivery quantities allowing point of delivery control to vary the delivery quantity to individual locations. The software options are: Preset conditions; Owner/operator input via external computer for loading delivery and trip instructions; Instructional output on LCD screen to driver on customer information and scheduling; Data download to owner/operator on billing information, driver daily activities and volume of propane remaining in vehicle.

19 Claims, 5 Drawing Sheets

AUTOMATIC EMERGENCY SHUT-OFF SYSTEM FOR DELIVERY TRANSPORTS

BACKGROUND OF THE INVENTION

1. Field of the Invention (Technical Field)

The present invention relates to electronic measurement and control, and more particularly to a method and apparatus to monitor the dispensing of caustic liquids or volatile liquid fuels and automatically terminate the dispensing process without human intervention in cases where the dispensing line leaks or breaks.

2. Background Art

In the delivery of hazardous liquids or volatile fuels a leak can occur in the delivery hose and the delivery personnel are unable or unwilling to control and shut down the system thereby causing environmental concerns and harm to life through fire, explosion, or other dangerous conditions.

Current methods employ a means to monitor the dispensing process for liquid propane gas, for example, by focusing on the pressure in the delivery system. Delivery trucks are typically equipped with constant velocity pumps that provide a constant flow of fuel to the destination tank under the drive pump mechanism. Many of these delivery systems are equipped with pressure sensors to detect a break or rupture of the delivery line. Such systems are unable to detect a leak until it has become so major that the pump can no longer maintain the pressure in the system at which time an alarm is triggered. The methods employed are mechanical in nature and are relatively inflexible and unintelligent. The means by which these systems operate focus on setting fixed points relative to known values in the dispensing process. Wide margins must be set to insure the system does not indicate falsely, thereby, allowing room for failures to go undetected. For example, a small hose leak would be indiscernible in a fixed point system. In some cases, the set points are fixed around a variable static pressure point. In this case, the pressure can vary but the relative trigger point is still fixed relative to the overall operation.

A typical pressure monitoring system typically works in the following manner. On arrival at a delivery location the operator either engages the power take off (PTO) from inside the vehicle or exits the vehicle and engages the PTO from the back of the vehicle. He proceeds to unroll the hose and take it to the tank where he checks the tank for current certification, makes the connection and returns to the back of the truck where he opens the main tank valve and increases the engine RPM to the proper delivery speed. He delivers a set amount per instructions or fills the tank to approximately eighty (80) percent. It is during this time that a leak may occur in the delivery system. The connection could come loose, the hose could rupture or a small leak could occur due to wear on the hose. The operator is then required to shut down the PTO, close the main tank valve and idle the engine. The time required to perform these tasks permits the loss of rapidly expanding volatile gas. On completion of the delivery the operator reduces the RPM, closes the main tank valve and disengages the PTO. The excess pressure is bled back in to the main tank and the operator removes the hose from the customer's tank and returns it to the vehicle. If leak or break in the line occurs, the prior art systems rely on pressure sensors that monitor the liquid pressure and close valves when a predetermined pressure point is achieved.

U.S. Pat. Nos. 5,823,235 and 5,999,087 are two prior art methods that monitor the pressure and react to changes as described above.

Other prior art systems use mechanical hose plugs where the pressure drop will trigger the release of a plug to block the line.

Current systems are relatively inflexible in their implementation. The systems do not and cannot operate dynamically taking variable conditions under consideration. For instance, current methods do not cover low level leaks because pressure remains constant and the pressure switch trigger systems will not activate. In the flow of a liquid the pressure will remain relatively constant in the presence of a leak unless the line is completely severed. With a constant volume of fluid being pumped under pressure, the pressure drop would not be significant at the measuring point. The most common fail mode is a smaller rupture or hole where the flow will increase dramatically with a small decrease in pressure.

The present invention addresses the flow of the system and can detect the slightest leak and alarm the system long before the present prior art systems by monitoring the flow of the liquid. Even under conditions where the pressure begins to drop, this invention will arrest the leak if the flow rate increases.

SUMMARY OF THE INVENTION (DISCLOSURE OF THE INVENTION)

Liquid Propane Gas expands exponentially when released into the atmosphere and being heavier than air collects in pockets where it is more likely to encounter fire, sparks, and other means of causing the gas to ignite with explosive force. Operators fear the result of a propane leak and may abandon a leaking vehicle instead of stopping the leak. Devices that must be attended by operators are fallible. This present invention, a self-monitoring system, is based on flow and pressure scientific data and the only operator functions are starting the sequence of events and ending the sequence after successfully delivering the load. In the event of over revving the engine by the operator, a warning is transmitted to the operator with a dwell time for the revolutions to be brought into pump manufacturers specs preventing damage to the vaned pump. Once delivery has started the system will shut down automatically in a few seconds after a leak is detected. This is a function of flow and pressure. This shut down interval is preset allowing the least amount of fuel to escape. The shut down sequence is complete and involves closing an electrically actuated inline ball valve and electronically interrupting the electrical flow to the vehicle's coil shutting down the motor preventing back pressure build up on the pump and delivery system. A manual emergency shut down button is on the rear of the vehicle.

The current invention monitors flow rather than pressure to activate the shut-off mechanism. In the case where the delivery pump is a constant velocity type the system is limited in its ability to increase flow once set. If a leak were to occur with this type of pump, logic would suggest that the flow would not increase thereby making this invention inoperable. Contrary to this logic, in the pumping process the liquid or gas is under pressure from being pushed by the pump and restricted by the nozzle and the resistance of the walls of the conduit. When a leak occurs the escaping gas or liquid will flow through the hole as through the nozzle with pressure behind it. The hole must grow large enough to exceed the deliverable flow capacity point of the pump. The pump can maintain pressure under varying conditions but the flow will always increase.

The pressure of the main tank will vary throughout the day due to the temperature and depletion of its contents.

Each time the system is activated to start a new delivery or transfer, new readings of pressure are taken for reference. Pressure is monitored to insure the system is ready to commence delivery and for the purpose of knowing if an overfill or kinked hose has occurred to stall the flow. A slowing of the flow is a natural operation at the end of a manual fill and is not used to trigger an alarm.

The preferred method for automatically shutting off a delivery system for a transfer of caustic or volatile liquids from a delivery container to a destination container when a leak occurs in the delivery system comprises determining if the liquid is pressurized in the delivery system, starting a flow of the liquid if the liquid is pressurized, monitoring a flow of the liquid, comparing the monitored flow of the liquid with a predetermined flow level, and terminating the flow of the liquid if the monitored flow exceeds the predetermined flow level. The method can also further comprise the step of performing initial systems checks and displaying delivery system status information. The preferred steps of starting a flow and terminating the flow comprise activating a valve. The preferred step of terminating the flow further comprises killing a liquid pump engine. The preferred step of comparing, further comprises delaying the comparing step for a predetermined amount of time. The method can also comprise logging delivery activities and downloading the logged delivery activities onto a computer. The method can also comprise the step of providing security mechanisms to avoid unauthorized access to the delivery system.

The preferred automatic shutoff apparatus for a delivery system when a leak occurs, the delivery system for transferring caustic or volatile liquids from a delivery container to a destination container, comprises a pressure sensor for verifying pressure in the delivery system, an apparatus to begin a flow of the liquid if the liquid is pressurized, a liquid flow monitor, structure for comparing an output of said liquid flow monitor with a predetermined flow level and an apparatus for terminating the flow of the liquid if said output exceeds the predetermined flow level. The preferred apparatus for beginning a flow and the apparatus for terminating a flow comprises a valve. The preferred valve further comprises an actuator. The preferred apparatus for terminating further comprises an engine kill apparatus. The automatic shutoff apparatus can also comprise a timer for delaying an activation of the structure for comparing. The automatic shutoff apparatus can also comprise an activity log. The activity log can also include a structure to download the activity log onto a computer. The activity log preferably comprises liquid pressure, liquid flow and liquid delivery amount. The activity log can also include a date of delivery, name of customer and address of customer. The invention can also comprise a security apparatus for preventing unauthorized use of the delivery system. The preferred security apparatus comprises a security code.

A primary object of the present invention is to provide a method and apparatus to immediately stop the flow of liquid upon the detection of a leak or rupture in the distribution system.

Another object of the present invention is to provide a means to automatically shut off the power train unit when a leak or rupture occurs in the distribution system.

Yet another object of the present invention is to provide a constant means for monitoring of liquid flow during delivery to detect possible leak in system.

Another object of the present invention is to provide a tally of total product pumped/delivered, incremental tally of individual delivery stops and a date and time stamp for every activity monitored.

Another object of the present invention is to provide a computer interface to a main computer to upload and download delivery and customer data.

Another object of the present invention is to provide automatic monitoring of system pressure and flow for automatically shutting down the system when the predefined amount of product is delivered or when the tank has reached a predetermined percentage total capacity.

A primary advantage of the present invention is that it monitors the flow rate of the liquid through the delivery system.

Another advantage of the present invention is that it is a self monitored system and an automatic system and requires no operator input.

Yet another advantage of the present invention is that it not only shuts off the flow during normal delivery of the delivered liquid, but also shuts off the flow when an inadvertent or accidental leak or rupture occurs.

Another advantage of the present invention is that the intelligent transducer converts a voltage input into relative flow and pressure data.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS

Best Modes for Carrying out the Invention

Figure 1:
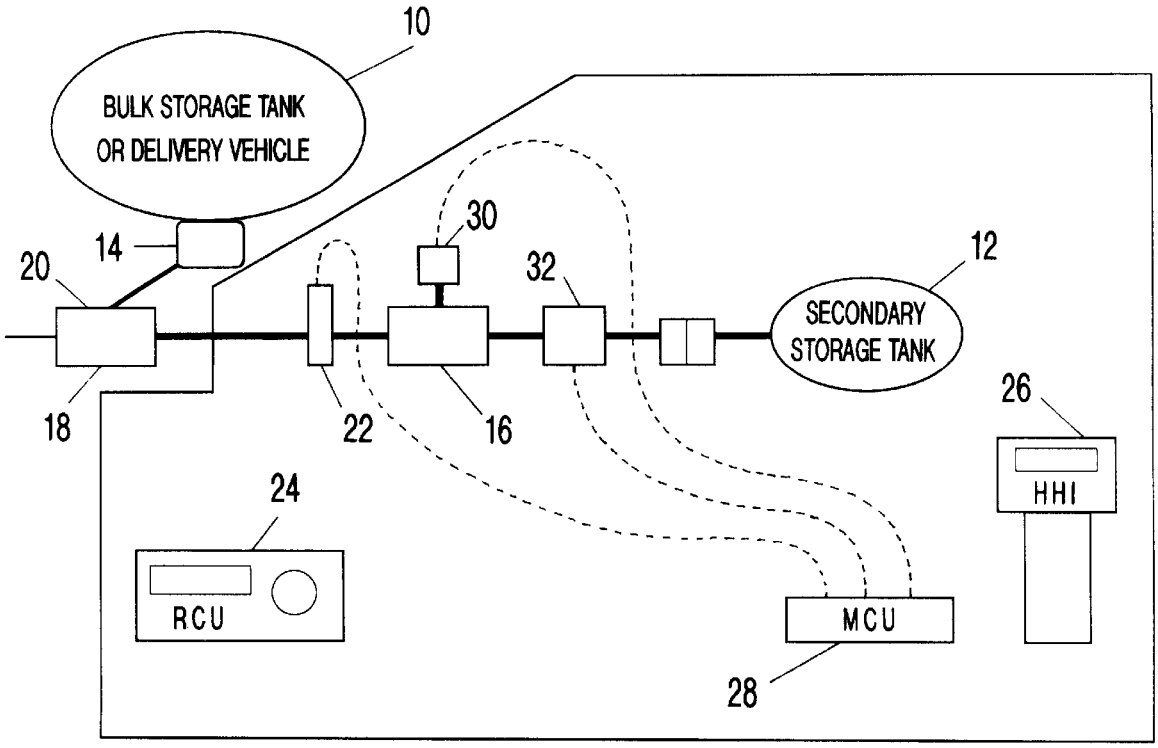
FIG. 1 is a schematic representation of the preferred automatic safety shut-off system.

FIG. 1 shows a schematic of the preferred embodiment of the invention mounted upon a transport or delivery vehicle. Secondary storage tank 12 is typically located at a fixed location to be filled. Although this embodiment is described for the use with liquid propane gas, the present invention can be used for any gas or liquid pumped from one storage containment vessel to another. The transport vehicle has a containment tank 10 that carries a supply of propane for delivery to a secondary storage tank 12 at a destination site. Upon delivery, main tank valve 14 at the bottom of the transport tank 10 is opened manually or electronically to allow fuel to flow up to the automatically controlled ball valve 16. The operator will engage PTO 18 to pump 20, allowing the pressure to increase at pressure sensor 22. The operator will then start the delivery process by pressing the start button 50 if near the remote control unit (RCU) 24 or the start button 44 if near the hand held interface (HHI) 26 of the operator control units. At this point the main control unit (MCU) 28 will perform the following functions:

1. Start a 30 second timer prior to going into alarm mode to allow the operator time to set the delivery flow rate;
2. Verify the system has pressure and take readings to establish current references; and
3. Signal actuator 30 to open ball valve 16 and verify product flow by flow transducer 32.

During the 30 second period, as the operator is revving up the engine or motor to achieve the desired flow rate for delivery, a beeper will sound if any parameters monitored are out of range. Once the 30 second timer has timed out, the system is in the alarm mode. In this mode the MCU 28 will react and shut down the system if the pressure exceeds a preset value, or the flow increases by as little as one tenth (1/10) of a gallon. Either of these two condition comprises a shut-down condition and the MCU 28 will kill the vehicle's engine, in turn depriving the motor driven pump 20 of it's power source, activate actuator 30 and close ball valve 16.

At the end of a delivery or transfer session, the MCU 28 will allow the operator to manually slow the flow and terminate the process by pressing the stop button on RCU 24 or HHI 26. MCU 28 will sense the stop button press, check pressure sensor 22 and flow transducer 32, record all data in MCU 28, signal actuator 30, which closes ball valve 16 to stop the flow of product.

Figure 2:
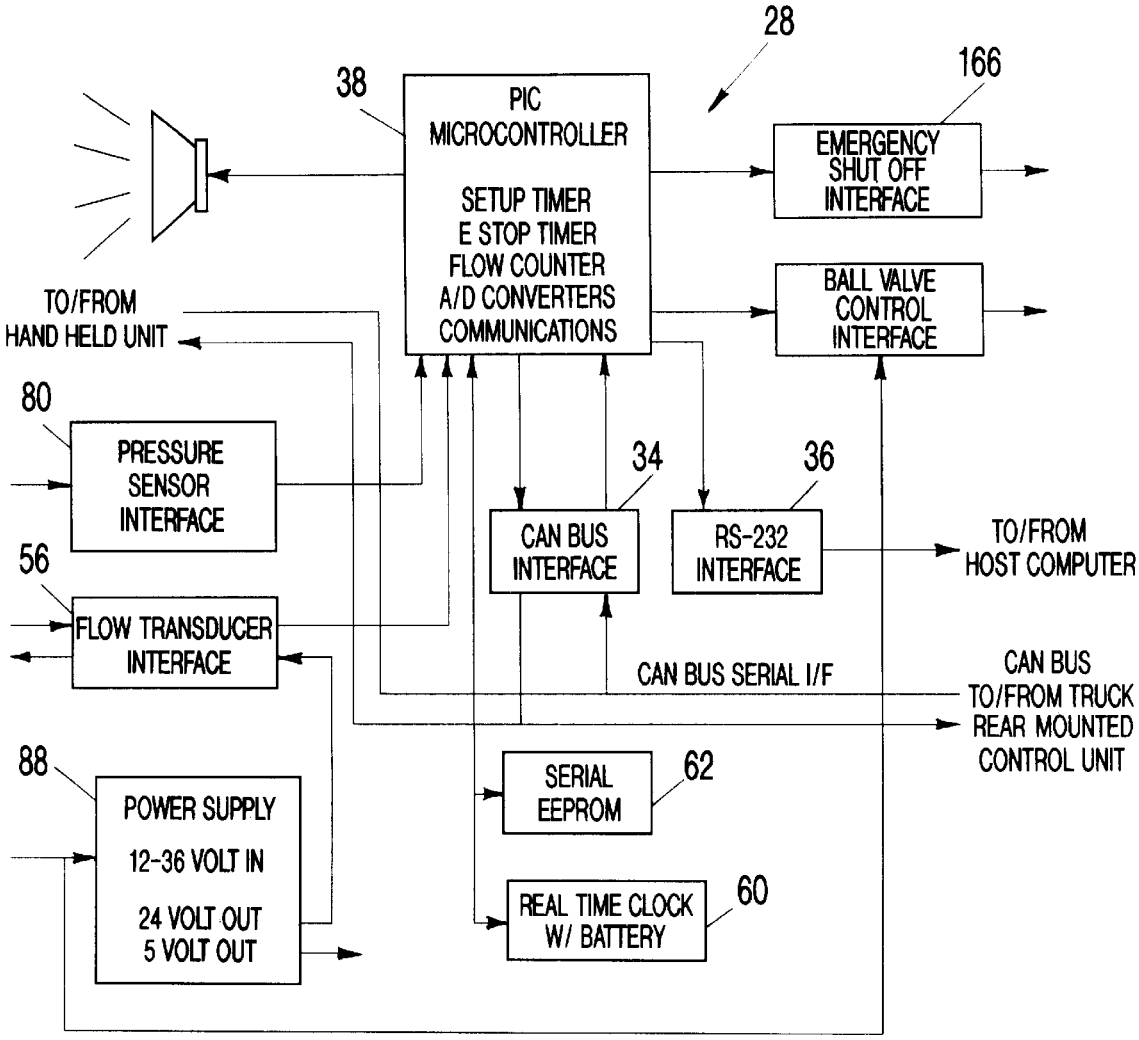
FIG. 2 is a diagram of the preferred main control unit.
Figure 3:
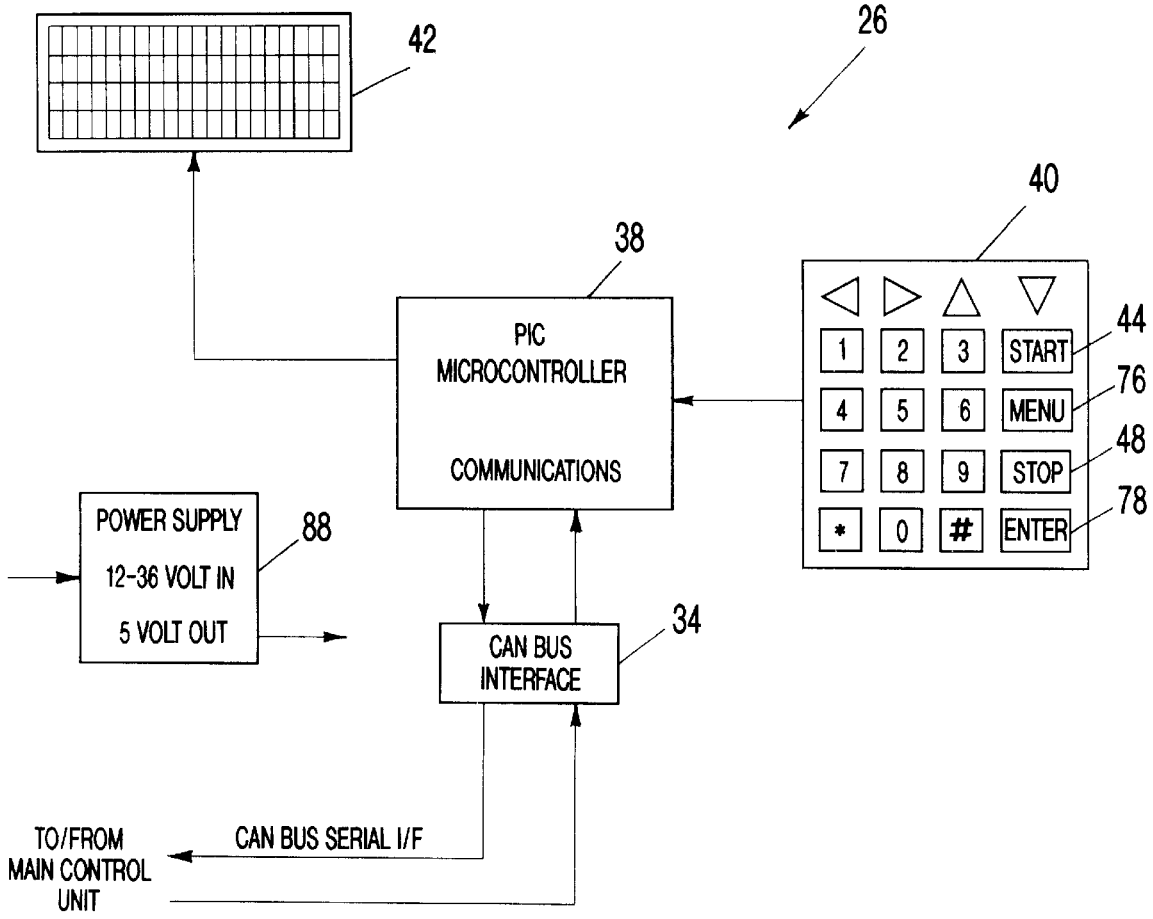
FIG. 3 is a diagram of the preferred hand held interface.
Figure 4:
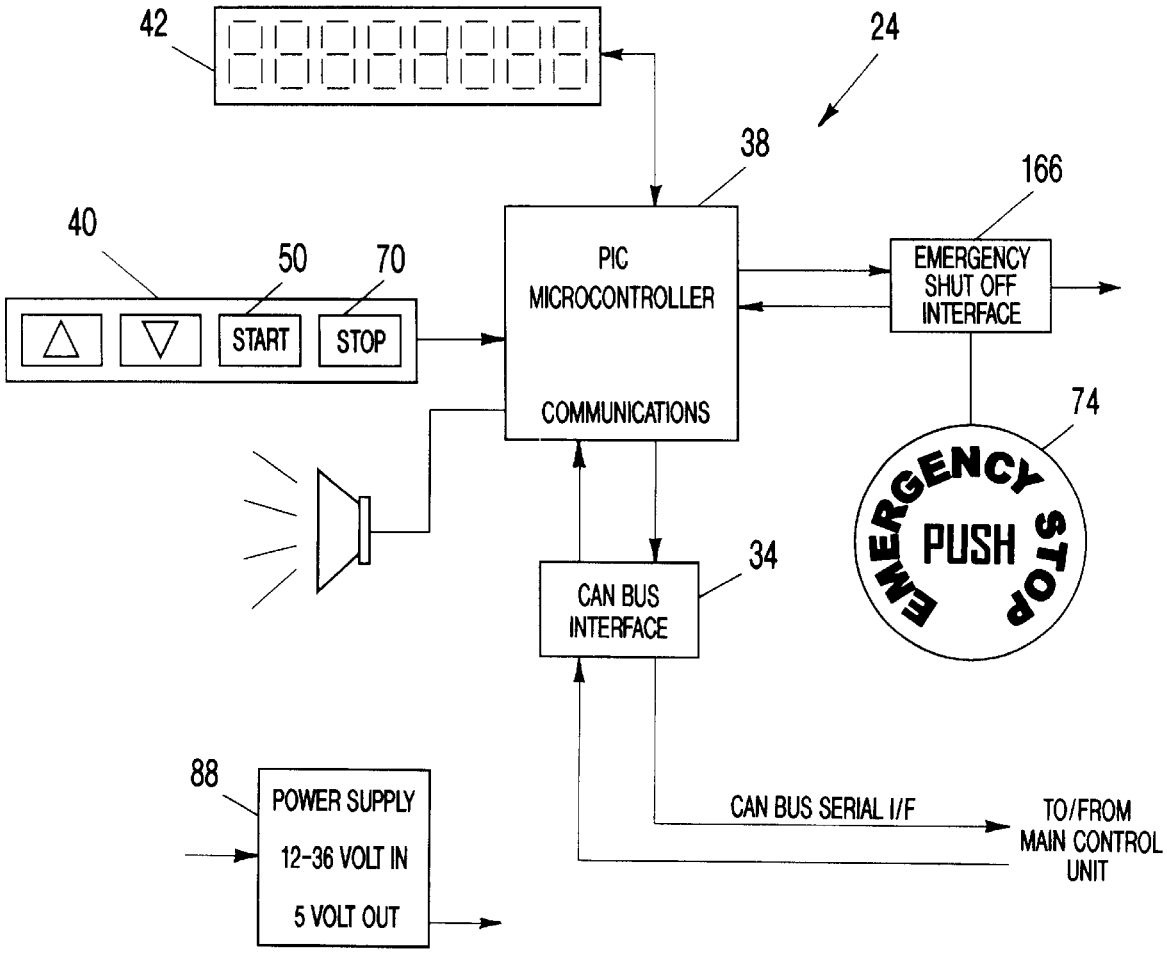
FIG. 4 is a diagram of the preferred remote control unit.

FIGS. 2, 3, and 4 show the preferred control and monitor components, the MCU 28, FIG. 2, the HHI 26, FIG. 3, and the RCU 24, FIG. 4. Pressure sensor 22 and flow transducer 32, shown in FIG. 1, send data to the MCU 28, which controls the emergency shut off interface 166, which in turn controls the actuator 30 and the ball valve 16.

Each unit will contain a printed circuit board (PCB) with a micro controller, support electronics and controller area network (CAN) bus 34 for communications between the units. MCU 28 monitors all system activity and controls the in line flow ball valve 16 of the dispensing system. In fault situations, MCU 28 will activate and shut the system down by killing the engine and closing the flow ball valve 16. Communications to the HHI 26 and RCU 24 occur as a regular function of the system to provide user updates on system status. HHI 26 allows user access to the major system functions and RCU 24 is limited to minor system functions.

MCU 28, as shown in FIGS. 1 and 2, is the heart of the system. The MCU 28 through its components and associated software performs a multitude of functions and monitors several functions of the entire system. These include monitoring the system pressure, the system flow through flow transducer 32, stop button 70, tamper switch 102, and maintaining communication between units on CAN bus 34. MCU 28 reads a flow transducer 32 and pressure sensor 22 through a flow transducer interface 56 and pressure sensor interface 80. Tamper switch 102 prevents manual manipulation of any component within MCU 28. The information derived from these sensors is used to control actuator 30 and ball valve 16 of FIG. 1, opening and closing it as required. The software is designed to suit the actions of delivering liquid products from a transport vehicle and operates the valves accordingly. A serial interface 36 such as a RS-232 interface, is provided to allow the service personnel access to delivery records stored in the memory of the micro controller 38 and to upload new delivery and system information. Date and time records are kept while the system is in operation and will log all activity occurring in the system. Service personnel uploading information may include the delivery route by customer address, closest major intersection or cross roads and amount of fuel to be dispensed, if known. In the case where a predetermined fuel amount is known the system can monitor the flow and shut the system off when the delivery is complete.

HHI 26 provides the primary user interface for the system, as shown in FIG. 3. All major system functions are provided to the users through this device. Passwords, system log information, time, date, pressure, flow, product delivered, and specific delivery information are all available. The HHI 26 incorporates a keypad 40 and graphic display 42 and communicates over a CAN bus 34 through a cord, such as a coil cord, or the like, interface 36 to MCU 28. HHI 26 provides the primary human interface to the system. System status, security, driver delivery information are the primary functions. The health of the system is the most important component in a system such as this and the continuous monitoring of the sensor components occurs every 10 ms. The display is constantly updated with current readings from the sensors provided by MCU 28.

Referring to FIG. 4, RCU 24 allows the user access to system runtime information and keys to scroll through the menu screens for specific status. The RCU 24 also contains a micro controller 38 and communicates on CAN bus 34 to real time system performance data from MCU 28. RCU 24 is the secondary human interface component of the system. The RCU 24 is preferably located in close proximity to the mechanical control elements of the delivery system. RCU 24 has an emergency stop button 74 that when pushed, instantly kills the engine and sends a message to the MCU which activates the actuator 30, and closes the ball valve 16. RCU 24 also has a display 42 to provide status read from the flow transducer 32 and pressure sensor 22 by the MCU 28.

As shown in FIGS. 2, 3, and 4, MCU 28, HHI 26 and RCU 24 have printed circuit boards encompassing microcontrollers 38, CAN bus 34 communication devices, real time clock 60, memory 62, analog to digital interfaces such as a 4–20 ma interface, displays 42, power supplies 88, and relays to control actuator 30 on ball valve 16 and an engine-kill interface to stop the engine driving the pump (not shown). The various elements are connected together with intrinsically safe electrical cables. Pressure sensor 22, flow transducer 32, and actuator 30 are located remotely and connected to the cable harness.

Figure 5:
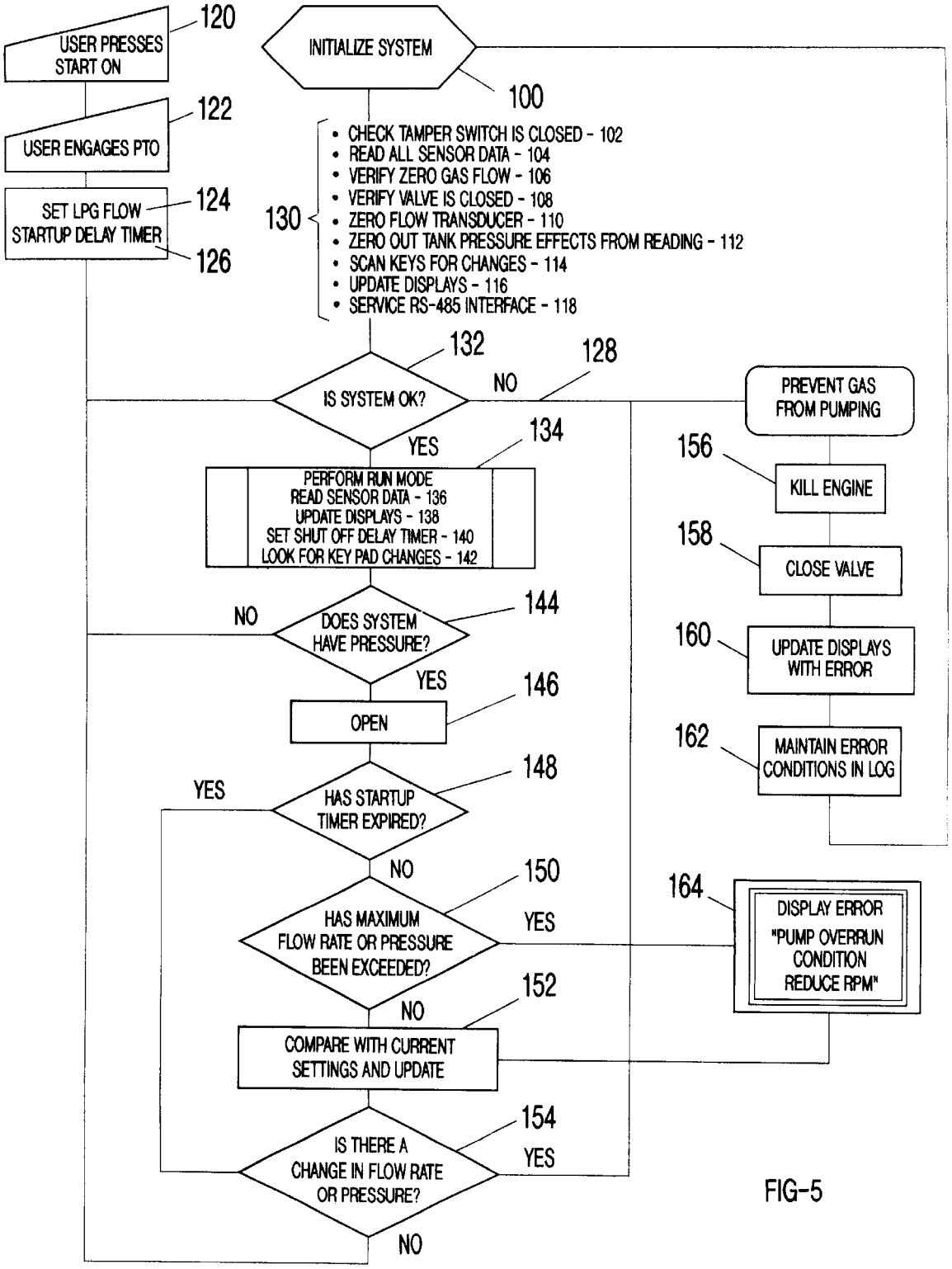
FIG. 5 is a flow chart showing the software controls of the preferred system.

FIG. 5 is a flow chart showing the process for the preferred system. The system is initialized 100 when the operator turns on the ignition of the delivery vehicle. A series of system checks 130 are performed: check that tamper switch is closed 102, sensor data is read 104, zero flow is verified 106, ball valve closure is verified 108, readings from the flow transducer are zeroed 110, zero out tank pressure effects from reading 112, keys are scanned for changes 114, the displays are updated 116 and the CAN bus 34 is serviced 118.

With the delivery vehicle full of fuel, the driver travels to the delivery location, a connection is made from the delivery vehicle to the receiving stationary tank, with the vehicles engine still running the operator initiates a delivery by pressing start 120 on the keypad from either the HHI or the RCU, opens the main tank valve on the delivery vehicle and engages the PTO 122 providing power to the vaned pump. By manually operating the rear throttle he regulates the RPM's of the vehicle to reach the optimum flow rate for his vehicle 124. The startup delay timer is set 126 to permit the operator a set period of time to meet the flow rate requirements then sets all the data in the MCU to a standard, which if exceeded, begins the shut down procedure 128.

The following sequence shows the logic for a safe delivery. At the end of this sequence is a series of checks that shut down the system in the event of a failure in the delivery system. The system runs a series of checks 130. If the checks are OK 132 then the systems performs the run mode 134 which includes reading sensor data 136, updating the displays 138, setting the shut off delay timer 140 and looking for keypad changes 142.

If the system has pressure 144, and the startup delay timer is activated 126, the ball valve is opened 146. If the startup delay timer has not expired 148, the start up sequence continues by checking to determine whether the maximum flow rate or pressure has been exceeded 150. If the maximum flow rate or pressure has not been exceeded a comparison is made with the current settings and the displays are updated 152. A constant flow of data is sent to the CPU to determine if there is a change in the flow rate or pressure 154. If there is a positive indicator during the delivery the next step will terminate the delivery using the shut down procedure 128.

The shut down procedure 128 is initiated if any of the indicators are contrary to the safe delivery of fuel. For instance, if the maximum flow rate or pressure has been exceeded 150, the shut down procedure 128 is activated. In addition, if at startup 100, system is not OK, the shut down procedure 128 is activated. The shut down procedure 128 comprises killing the engine 156, preventing the ball valve from opening or will be closed, if open 158, all displays will be updated with the error condition 160 and maintain a log of the error conditions 162.

At startup 100 if the system does not have pressure 144 then the system is checked again 132 and the startup sequence begins over again 100 and the system will remain shut down until the operator opens the main tank valve or corrects the lack of pressure.

At the beginning of a delivery if the startup delay timer expires 126 and the operator has not met the optimum flow rate for his vehicle 124, a display error will be sent to the displays 164 and the system will shut down 128.

Industrial Applicability

The invention is further illustrated by the following non-limiting example.

EXAMPLE

Assuming that an automatic shut off system has been installed on a liquid propane gas commercial delivery vehicle and MCU 28 is installed in the cab of the vehicle, HHI 26 is attached to MCU 28 by a flexible cable and RCU 24 is mounted at the rear of the vehicle.

The owner/operator of the vehicle has provided the driver with a delivery itinerary and the truck has been loaded with the appropriate amount of fuel for the day's deliveries. All safety checks have been made and the equipment is ready for the driver.

Under normal operating conditions and while the vehicle is off duty, ball valve 16 is in a closed position. After normal delivery and without operator intervention ball valve 16 will be closed automatically by the actuator 30 within a preset time limit. MCU 28, HHI 26, and RCU 24 obtain electrical resources from the 12 Volt system of the host vehicle. An internal battery can supply power to maintain the current date and time for the system. The electronics of the system receive power when the driver turns on the vehicle ignition switch.

Upon arrival at the delivery site the operator opens the truck's main tank valve, engages the PTO on the truck which operates the vaned pump on the vehicle, removes the delivery hose from the reel on the back of the vehicle and takes it to the receiving tank and ensures the connection is secure (not shown).

From the rear of the truck the driver turns on the system by pressing the start button 50 on the RCU 24 which activates the actuator 30, opening ball valve 16. The operator begins increasing the speed of the vehicle's engine by the use of a manual throttle. Viewing the RCU display panel 42, the operator increases the RPM's on the vehicle's engine causing the vaned pump to deliver more fuel until the optimum operating flow rate is achieved. If the operator exceeds the optimum flow rate while increasing the speed of the engine, he has a preset time limit to meet the optimum flow rate.

During the delivery cycle the invented system monitors the flow and pressure rate and any detectable increase in flow rate will cause the system to close the ball valve 16 with actuator 30. Once the optimum flow rate has been achieved there is no tolerance permitted. If an increase in flow rate is detected, and if the system operator detects a problem with the delivery, he may push the emergency stop button 74, which causes a complete shut down including closing ball valve 16, and interrupting the ignition of the delivery vehicle causing the motor to stop, eliminating the pressure on the system from the vaned pump.

After a successful delivery the operator decreases the vehicle's RPM's, presses the stop button 70 on keypad 40, which activates the actuator 30 closing the ball valve 16, then the driver closes the vehicle's main tank valve and disengages the PTO, which relieves the pressure on the system. The operator then uncouples the hose from the delivery tank and reels in the hose.

If the emergency stop button 74 on the RCU 24 is depressed, the vehicle engine is stopped, and a message is sent to MCU 28 by RCU 24 and the sense of the emergency switch is read directly by the MCU 28 which signals the actuator 30 closing the ball valve 16. An audible alarm is sounded and error messages are displayed on the displays 42 of the HHI 26 and RCU 24.

The system permits owner/operator input with all the data required for a daily delivery schedule including but not limited to: daily load requirement; customers statistics; location, type and volume of LPGas receptacle; volumetric delivery records; downloadable records for tracking customer history; and individual and cumulative volume records.

The following screens will be seen on the HHI 26 to manage the system Initial Screen:

LPG 2000
BR&T Technology Development Corporation
6700 Edith Blvd. N.E.
Albuquerque, NM 87113-1156

After a minute the screen should change to show the system initialization Settings and Status.

System Reset

Initializing System .....

| | |
|---|---|
| Gas Pressure | 180 PSI |
| Gas Flow | 00.0 |
| Valve | Closed |
| Communication | Normal |
| Engine Kill | Off |

Assuming all systems are normal, switch to the security screen.

Enter Security Code xxxxxXXX

Press ENTER

The security screen will display for 1 minute and switch to the runtime screen. The runtime screen will be the default unless no security code or an invalid security code is entered. Pressing menu 76 will bring the proper screen up depending upon the state of the system and time between attempts.

The security screen will switch to the Time date screen after a minute with "system secure" shown.

LPG2000

Date: Mar. 08, 2001
Time: 10:45:00 AM
System Secure

Press MENU

Under normal conditions the system can be in one of three states:

Normal—System is operational and a valid security user code was entered.

Secure—System is operational and waiting for security code entry. The system will not dispense fuel. The truck will operate otherwise.

Locked—System is operational and the user locked the system or a hack attempt was placed on the system and the security code entry counter expired. This mode locks down the entire system. The truck will not run or dispense fuel.

The System administrator has the option to lock the system after X attempts to enter a valid security code or simply lock the truck for the evening. The truck can be shut down and the fuel dispensing hardware held closed and off.

Entering a valid security code twice consecutively will unlock a locked system.

LPG2000

Date: Mar. 08, 2001
Time: 10:45:00 AM
System Normal

Press MENU

-continued

LPG2000

Date: Mar. 08, 2001
Time: 10:45:00 AM
System Locked

Press MENU

Within the main menu the user can scroll to the desired function of interest then press enter 78 to select.

Main Menu

Address and Delivery Information
System Operation Menu
Event Log
System Settings
Delivery Total
Delivery Schedule

△ Scroll ▽

Address and Delivery Information
Tom Jones
123 W. Long Story Rd
Foothills, CA 97123
Deliver 100 Gallons.
Tank is located inside the gate …

△ Scroll ▽

The system operation menu gives the user an instantaneous running status of the systems' monitored sensors. The status will change from ready, to pump, to stop. The status will change for each sensor monitored every 250 ms as new data is taken.

The event log will track every change occurring in the system. Each time a delivery is made new data will be entered to the log. Information about the system will also be kept such as logon information and data transfers to the service system.

Event Log

Event 3:
Date: Mar. 08, 2001
Time: 08:40:23
Dispense Gal: 100
Event 2:
Date: 03/08/2001

△ scroll ▽

| | |
|---|---|
| Time: | 8:20:02 |
| Security Code entered | Successful |
| Truck Fill | 12,000 gal |
| System Reset | Successful |
| Data Download | Successful |
| Data Upload | Successful |

△ Scroll ▽

The System setting Menu will allow the user to change system parameters where allowed. Some parameters will only be allowed to change through the service port interface.

| System Settings | |
|---|---|
| Reset Gallons Delv'ed | 4500 |
| Reset Total Delv'ed | 8000.6 |
| Set Date | Mar. 08, 2001 |
| Set Time | 10:23:23 |
| Open Valve | |
| Close Valve | |
| Calibrate System | |

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above, are hereby incorporated by reference.

What is claimed is:

1. A method for automatically shutting off a delivery system for a transfer of caustic or volatile liquids from a delivery container to a destination container when a leak occurs in the delivery system, the method comprising:

a) determining if the liquid is pressurized in the delivery system;

b) starting a flow of the liquid if the liquid is pressurized;

c) setting a timer for a period of time to allow the flow of the liquid to reach an optimum flow rate level for a particular delivery;

d) recording the optimum flow rate level on a micro controller;

e) monitoring a flow rate of the liquid with a flow transducer;

f) comparing the monitored flow rate of the liquid with the recorded optimum flow rate level; and g) terminating the flow of the liquid if the monitored flow rate exceeds the recorded optimum flow rate level.

2. The method of claim 1 further comprising the step of performing initial systems checks.

3. The method of claim 1 further comprises displaying delivery system status information.

4. The method of claim 1 wherein the steps of starting a flow and terminating the flow comprise activating a valve.

5. The method of claim 1 wherein the step of terminating the flow further comprises killing a liquid pump engine.

6. The method of claim 1 wherein the step of comparing further comprises delaying the comparing step for a predetermined amount of time.

7. The method of claim 1 further comprising logging delivery activities.

8. The method of claim 7 further comprising downloading the logged delivery activities onto a computer.

9. The method of claim 1 further comprising the step of providing security mechanisms to avoid unauthorized access to the delivery system.

10. An automatic shutoff apparatus for a delivery system when a leak occurs, the delivery system for transferring caustic or volatile liquids from a delivery container to a destination container, the apparatus comprising:

a pressure sensor for verifying pressure in the delivery system;

a means to begin a flow of the liquid if the liquid is pressurized;

a timer to allow the flow of the liquid to achieve an optimum flow rate level for a particular delivery;

a recorder on a micro controller to record the optimum flow rate level;

a liquid flow rate monitor comprising a flow transducer;

a means for comparing an output of said liquid flow rate monitor with said recorded optimum flow rate level; and a means for terminating the flow of the liquid if said output exceeds said optimum recorded flow rate level.

11. The invention of claim 10 wherein the means for beginning a flow and the means for terminating a flow comprises a valve.

12. The invention of 11 wherein said valve further comprises an actuator.

13. The invention of claim 10 wherein said means for terminating further comprises an engine kill apparatus.

14. The invention of claim 10 further comprising an activity log.

15. The invention of claim 14 wherein said activity log further comprises a means to download said activity log onto a computer.

16. The invention of claim 14 wherein said activity log comprises liquid pressure, liquid flow rate and liquid delivery amount.

17. The invention of claim 14 wherein said activity log further comprises date of delivery, name of customer and address of customer.

18. The invention of claim 10 further comprising a security apparatus for preventing unauthorized use of said delivery system.

19. The invention of claim 18 wherein said security apparatus comprises a security code.

* * * * *